US005827579A

United States Patent [19]

Groshens

[11] Patent Number: 5,827,579

[45] Date of Patent: Oct. 27, 1998

[54] PROCESS FOR MANUFACTURING A FUSIBLE INTERLINING AND THE FUSIBLE INTERLINING THUS OBTAINED

[75] Inventor: Pierrot Groshens, Peronne, France

[73] Assignee: Laniere de Picardie, Peronne, France

[21] Appl. No.: 815,167

[22] Filed: Mar. 11, 1997

[30] Foreign Application Priority Data

Mar. 25, 1996 [FR] France ..... 96 03693

[51] Int. Cl.[6] ..... B05D 1/26; B05D 1/32; B05D 3/06

[52] U.S. Cl. ..... 427/552; 427/152; 427/210; 427/261; 427/288

[58] Field of Search ..... 427/152, 209, 427/210, 211, 261, 288, 552; 428/198, 212; 156/239; 101/129, 492

[56] References Cited

U.S. PATENT DOCUMENTS 4,732,800 3/1988 Groshens ..... 428/196
5,000,090 3/1991 Tecl et al. ..... 101/170
5,569,348 10/1996 Hefele ..... 156/239

FOREIGN PATENT DOCUMENTS 73 10282 9/1977 France ..... C09J 5/00
2576191 1/1985 France ..... A41H 43/04

*Primary Examiner*—Michael Lusignan
*Assistant Examiner*—Fred J. Parker
*Attorney, Agent, or Firm*—Michael D. Bednarek; Kilpatrick Stockton

[57] ABSTRACT

The invention concerns a process for manufacturing a fusible interlining (1) comprising a base fabric (2), a thermofusible first layer (5) applied on one of its faces (3) referred to as the front face, and a thermofusible second layer (7) applied on the rear face (4) of the base fabric (2), characterised in that the first layer (5) is deposited on the front face (3) of the base fabric (2) by means of a first screen printer (9); the second layer (7) is deposited on a transfer roller (11) by means of a second screen printer (10); the points (8) thus obtained are transferred onto the rear face (4) of the base fabric (2), the depositing of the first layer (5) and the transfer of the second layer (7) being performed simultaneously so that the points (6, 8) of the layers (5, 7) lie opposite to one another on the cross-sectional plane.

19 Claims, 1 Drawing Sheet

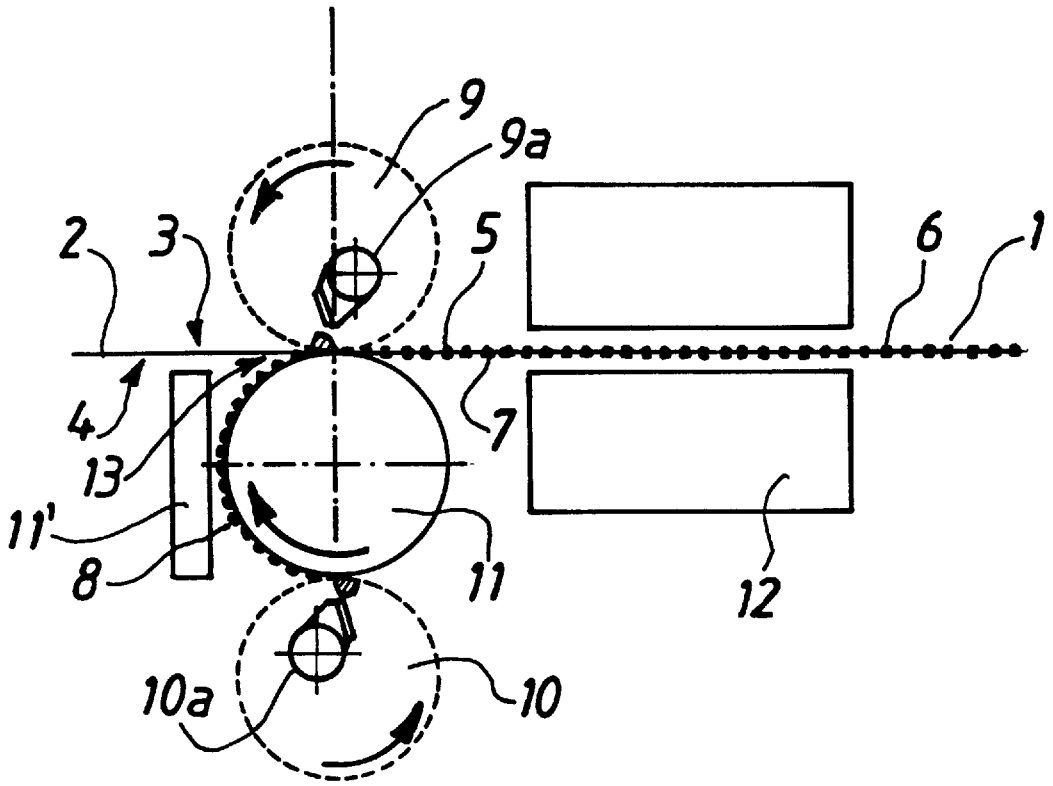
9
9a
2
3
5
6
1
4
7
13
11'
8
11
12
10a
10

PROCESS FOR MANUFACTURING A FUSIBLE INTERLINING AND THE FUSIBLE INTERLINING THUS OBTAINED

FIELD OF THE INVENTION

The invention concerns a process for manufacturing a fusible interlining and the fusible interlining thus obtained.

BACKGROUND OF THE INVENTION

It is known to achieve fusible interlinings made up of a base fabric on which a layer of thermofusible polymers distributed in points is deposited by coating.

These interlinings are specifically intended to be bonded on another textile, a cloth for example, so as to make up a complex whose physical properties, i.e. strength, springiness, softness, feel, volume, hand etc. can be controlled.

These properties of the complex result from the nature of the cloth, the nature of the base fabric, and also the nature of the composition and the mode of application of the fusible layer.

Once manufactured, the fusible interlining must be able to withstand storage at ambient temperature. It is then necessary that the various layers of this product, generally stored in rolls, do not adhere to one another. The fusible interlining must not have a sticky effect or adhesive properties at ambient temperature ("tack").

The fusible interlining is subsequently bonded on the cloths so as to obtain the complex wanted.

This bonding is usually achieved using a press operating at temperatures comprised between 100° C. and 160° C. under pressures ranging from a few decibars to a few bars during relatively short periods of time, in the order of 10 to 30 seconds.

During this phase, the thermofusible polymers of the interlining must at least partially recover their adhesive properties.

In the course of this operation, it is also necessary to avoid that these thermofusible polymers traverse the cloth or produce returns, i.e. traverse the base fabric of the interlining.

Indeed, such traverses and returns would produce an unaesthetic effect, making the interlining unfit for use or, at all events, giving the complex unsuitable properties contrary to those wanted.

The main result of such traverses and returns is that the fibers of the base fabric stick to one another, leading to a complex whose softness is mediocre. Indeed, this mediocre softness is partly due to the possible slewing of the complex, and therefore to the possibility of the textile fibers sliding over one another.

The traverse and return phenomena were observed when the use of fusible interlinings first began and many attempts have been made since then to avoid these defects.

Thus, document FR-A-2 177 038 has proposed to achieve an interlining by successively depositing two adhesive layers on a base fabric. The first layer is applied by coating a viscous dispersion (paste) containing polymers with a high viscosity and/or a high melting point directly on the base fabric by means of a screen printer.

The second layer is applied by powdering a powder of thermofusible polymers with a viscosity and/or a melting point inferior to those of the first layer.

The points of the first layer have an adhesive surface, due to the nature and composition of the compounds making up the latter. Thus, the thermofusible material scattered in the form of a fine powder over the coated base fabric settles by gravitation on the entire base fabric, but it adheres more firmly to the paste points.

Since the materials used for the sublayer have a melting point higher than to those of the thermofusible layer, they form a shield and, theoretically, the adhesive does not flow through the base fabric when the interlining is bonded on a cloth.

However, since the points of the sublayer have a spherical or ellipsoidal shape, the particles of thermofusible material stick to the entire surface of the paste point, particularly at the point of contact between the paste point and the base fabric; this results in the thermofusible material present at the point of contact flowing through the base fabric, with the sublayer unable to act as a shield during the bonding, thus producing traverses.

Moreover, due to its irregular surface, the sublayer penetrates more or less into the base fabric during the coating. The adhesive surface of the sublayer therefore varies and, as a result, the quantity of particles varies as well, producing a very negative effect on the adhesive forces between the interlining and the cloth and, in particular, on the non-homogeneity of these adhesive forces.

Furthermore, according to the process described in document FR-A-2 177 038, a coating roller similar to those used for heliographic purposes is used. But the quantities of powder deposited in the cavities of the roller are therefore not very precise. As a result, the layers obtained are not uniform.

In addition, the upper layer of adhesive must adhere to the lower layer. Hence, according to this process, sintering is usually performed so as to enable the upper layer to adhere to the lower layer.

Moreover, in such a process, the chemical compositions of the sublayer and the upper layer must be compatible.

The known art can also be represented by document FR-A-2 576 191, which describes an interlining comprising a thermofusible first layer applied on the front face of a base and a second layer with a higher melting temperature than the first, applied on the rear face of said base.

SUMMARY OF THE INVENTION

A first object of the present invention is to propose a process for manufacturing a fusible interlining and the interlining thus obtained which eliminates the limitations or disadvantages of those known in the art.

More particularly, an object of the present invention is to propose such a process with which the thermofusible material does not flow through the base fabric when the interlining is bonded on the cloth.

For this purpose, the invention concerns a process for manufacturing a fusible interlining comprising a base fabric, a thermofusible first layer applied on one of its faces referred to as the front face, and a second layer whose melting temperature is higher than to that of the first, applied on the rear face of the base fabric, characterised in that:

- the first layer is deposited distributed in points on the front face of the base fabric by means of a first screen printer;
- the second layer is deposited distributed in points on a transfer roller comprising a regular and smooth surface by means of a second screen printer;
- the points with a flat surface and low thickness thus obtained are transferred onto the rear face of the base fabric, the depositing of the first layer and the transfer of the second layer being performed simultaneously so that the points of the layers lie opposite to one another on the cross-sectional plane.

The textile thus coated is submitted to electromagnetic radiation and/or electron bombardment and/or a heat treatment.

According to another aspect, the invention also concerns a fusible interlining characterised in that it is obtained by implementing a process according to the present invention.

BRIEF DESCRIPTION OF THE DRAWINGS

Further characteristics and advantages of the present invention will be clearly understood upon reading the following description made with reference to the single attached drawing, which is a schematic view of a device illustrating the manufacturing process of a fusible interlining according to the invention.

DETAILED DESCRIPTION

The fusible interlining 1 according to the invention comprises a base fabric 2 coated with a layer 5, 7 of thermofusible polymers on each of its faces 3, 4.

The base fabric 2 itself is well known. It is of the same nature as those conventionally implemented in the field of interlining.

It can be a woven, knitted or nonwoven textile. Most often, these textiles are transformed and then undergo finishing operations before being used as a coating base.

The base fabric 2 comprises a thermofusible first layer 5 applied on the front face 3 of the base fabric 2 and a second layer 7 applied on the rear face 4 of the base fabric 2. The first layer 5 is thermofusible whereas the second layer 7 has a melting temperature higher than that of the first layer 5. The term thermofusible refers to a layer which allows for hot bonding, which is solid and free of adhesive capacity at ambient temperature, but which, at high temperatures, has plastic properties and is therefore partly pasty, flowing but adhesive. Thus, the first layer 5 has a thermoplastic flow superior to the thermoplastic flow of the second layer 7.

The fusible interlining 1 is such that the second layer 7 acts as a barrier or a shield with respect to the first layer 5, i.e. it keeps the return phenomenon described above from taking place.

The manufacturing process of the fusible interlining 1 is such that a layer 5, 7 of thermofusible polymers is simultaneously deposited on each face 3, 4 of the base fabric 2. The thermofusible first layer 5 is deposited directly on the front face 3 of the base fabric 2, whereas the second layer 7 is deposited by transfer on the rear face 4 of the base fabric 2.

For this purpose, the first layer 5 is deposited and distributed in points 6 on the front face 3 of the base fabric 2 by means of a first screen printer 9. The second layer 7 is deposited distributed in points 8 on a transfer roller 11 comprising a regular and smooth surface, by means of a second screen printer 10; the points 8 are then transferred onto the rear face 4 of the base fabric 2, the depositing of the first layer 5 and the transfer of the second layer 7 being performed simultaneously so that the points 6, 8*a* of the layers 5, 7 lie opposite to one another on the cross-sectional plane.

The depositing of the thermofusible first layer 5 and of the second layer 7 is performed by means of the screen printers 9 and 10, respectively. These rotary screen printers 9 and 10, which are known of, cooperate with a squeegee 9*a*, 10*a*, respectively, on the one hand, and both cooperate with the transfer roller 11 on the other hand.

In other words, the transfer roller 11 serves as a counter-roller for the first screen printer 9, whereas the latter serves as a counter-roller for the transfer roller 11.

As a result, the first screen printer 9, the second screen printer 10 and the transfer roller 11 are superimposed, with their axes of rotation lying on the same plane and perpendicular to the direction of movement of the base fabric 2.

The screen printers 9, 10 make it possible to implement wet coating processes wherein very fine powders of polymers in aqueous dispersion are applied on the base fabric 2 and on the transfer roller 11 by a hollow squeegee 9*a*, 10*a*, respectively, installed within the rotary roller, which has a thin perforated wall. The squeegees 9*a*, 10*a* produce the passage of the paste making up the layers 5 and 7 through the perforations in the screen printers 9 and 10, respectively.

In a preferred embodiment, the first 9 and second 10 screen printers have the same diameter and comprise the same cross-linkable set of perforations.

The composition of the thermofusible first layer 5 deposited on the front face 3 of the base fabric 2 comprises at least one polymer or at least one thermoplastic copolymer such as, for example, a polyethylene, a copolyethylene, a polyamide, a polyester, a copolyester in the form of a dispersion/solution of these compounds. It can also consist of a mixture of these compounds.

The composition of the second layer 7, deposited on the rear face 4 of the base fabric 2, varies according to the applications. For example, it can include an antiadhesive, possibly consisting of a product comprising silicon.

The second layer 7 comprises cross-linkable or non cross-linkable polymers whose melting temperature is higher than that of the polymers of the thermofusible layer 5.

In certain cases, finely ground materials are used whose melting point is higher than that of the material used for the first layer 5, such as polyethylenes. In other cases, reactive materials are used so that their melting points are also higher than those of the material used for the first layer 5. Thus, aminoplastic mixtures, acrylic resins, aminoplastes and polyurethanes, epoxy and acrylic-urethanes are particularly suitable.

In order to achieve a coating paste with these polymers, they are used dispersed in water. To obtain a pasty mixture, thickeners are added.

This paste is then deposited on the transfer roller 11 by the second screen printer 10 and by means 11' and then undergoes transformations intended to evaporate all or part of the solvent, and/or to make the polymers react with the paste and/or to melt the finely ground polymer particles.

The next step consists of transferring the set of points 8 of the second layer 7 onto the rear face 4 of the base fabric 2. To make the transfer possible, the base fabric 2 is pressed between the transfer roller 11 and the first screen printer 9.

For this purpose, the first screen printer 9 and the transfer roller 11 are tangent to one another at a point 13, with the base fabric 2 running between the first screen printer 9 and the transfer roller 11 also tangent to each of them at the point 13. In addition, the perforations in the first screen printer 9 correspond to the points 8 of the second layer 7 at least at the point of contact or tangency 13 of the base fabric 2 with the first screen printer 9 and the transfer roller 11.

As a result, since the adhesion energy between the second layer 7 and the base fabric 2 is superior to that between the second layer 7 and the transfer roller 11, the transfer takes place at the point of contact 13 between the transfer roller 11 and the base fabric 2.

The points 8*a* of the second layer 7 thus transferred have a flat surface and a low thickness and are arranged on the surface of the base fabric 2.

The depositing of the second layer 7 on the transfer roller 11 by the second screen printer 10 is therefore performed prior to the depositing of the first layer 5 directly on the front face 3 of the base fabric 2 by the first screen printer 9.

For this purpose, the peripheral speed of the first screen printer 9, of the second screen printer 10 and of the transfer roller 11 is adjusted so that the points 6, 8*a* of the layers 5, 7 lie opposite to one another on the cross-sectional plane.

The base fabric 2 coated with the points 6, 8*a* opposite to one another then passes through a heating and/or radiation chamber 12, particularly in order to evaporate the solvent if necessary, to transform the second layer 7 so that its melting point is higher than that of the first layer 5, and to melt the polymers making up the first layer 5.

The invention also concerns a fusible interlining obtained by implementing the process described above.

I claim:

1. A process for manufacturing a fusible interlining using a base fabric having a front face and a rear face, the front face and the rear face being opposite one another, comprising the steps of:

depositing a first thermofusible layer in the form of distributed points onto a front face of a base fabric by means of a first screen printer;

depositing a second thermofusible layer, the second thermofusible layer possessing a higher melting temperature than the first thermofusible layer, in the form of distributed points from a second screen printer to a transfer roller, the transfer roller comprising a regular and smooth surface;

transferring the second thermofusible layer in the form of distributed points from the transfer roller to the rear face of the base fabric;

pressing the base fabric between the transfer roller and the first screen printer such that transferred points with a generally planar surface and a generally uniform thickness are obtained; and exposing the base fabric, with the first and second thermofusible layers applied, to a treatment such that the second thermofusible layer transforms and the first thermofusible layer melts;

wherein the depositing of the first thermofusible layer on the front face of the base fabric and the transfer of the second thermofusible layer on the rear face of the base fabric are performed simultaneously at the point of contact of the base fabric with the transfer roller and the first screen printer, such that the points of the first and second thermofusible layers lie opposite to one another on the base fabric.

2. The process according to claim 1, further comprising the first screen printer, the second screen printer and the transfer roller have an adjusted peripheral speed so that the points of the first and second thermofusible layers lie opposite to one another on the base fabric.

3. The process according to claim 1, further comprising, that the first thermofusible layer comprises a polymer.

4. The process according to claim 3, such that the polymer further comprises at least one from the group consisting of polyethylenes, polyamides, and polyesters.

5. The process according to claim 1, such that the second thermofusible layer comprises one from the group consisting of a cross-linkable polymer and a non cross-linkable polymer, wherein the cross-linkable polymer and the non cross-likable polymer each have a melting temperature higher than the melting temperature of the first thermofusible layer.

6. The process according to claim 1, further comprising that the first screen printer and the transfer roller are tangent to one another at a point of contact with the base fabric, the base fabric running between the first screen printer and the transfer roller at the point of contact.

7. The process according to claim 1, further comprising that the first screen printer has perforations which correspond to the points of the second thermofusible layer at least at the point of contact of the base fabric with the first screen printer and the transfer roller.

8. The process according to claim 1, further comprising that the first and second screen printers comprise cylinders of the same diameter and comprise a same set of perforations.

9. The process according to claim 1, further comprising that the axes of rotation of the first screen printer, the second screen printer and the transfer roller lie on the same plane and the plane is perpendicular to the direction of movement of the base fabric.

10. The process of claim 1 wherein the base fabric comprises a woven textile.

11. The process of claim 1 wherein the base fabric comprises a knitted textile.

12. The process of claim 1 wherein the base fabric comprises a nonwoven textile.

13. The process of claim 1 wherein the treatment comprises electromagnetic radiation.

14. The process of claim 1 wherein the treatment comprises electron bombardment.

15. The process of claim wherein the treatment comprises heat treatment.

16. The process of claim 1 wherein at least one from the group consisting of the first thermofusible layer and the second thermofusible layer comprises a solvent, and wherein the step of exposing the base fabric, with the first and second thermofusible layers applied, to a treatment further includes the step of exposing the base fabric, with the first and second thermofusible layers applied, to a treatment such that the solvent evaporates.

17. The process of claim 1 wherein the second thermofusible layer comprises a solvent, and further comprising a step of the second thermofusible layer transforming after the transferring step and prior to the pressing step such that the solvent in the second thermofusible layer evaporates.

18. The process of claim 1 wherein the second thermofusible layer comprises a polymer and a paste, and further comprising a step of the polymer reacting with the paste.

19. The process of claim 1 wherein the second thermofusible layer comprises a finely ground polymer, and further comprising a step of the finely ground polymer melting.

* * * * *